United States Patent [19]

Vogel

[11] 4,106,302

[45] Aug. 15, 1978

[54] OFF-SHORE DRILLING AND PRODUCTION PLATFORM AND METHOD OF BUILDING SAME

[75] Inventor: Rudolf Vogel, Salzgitter, Germany

[73] Assignee: Maschinenfabrik Augsburg-Nurnberg Aktiengesellschaft, Nurnberg, Germany

[21] Appl. No.: 686,685

[22] Filed: May 17, 1976

[51] Int. Cl.[2] ..... E02B 17/00

[52] U.S. Cl. ..... 61/94; 61/95; 61/98; 61/99; 61/96

[58] Field of Search ..... 61/86, 87, 94, 95, 96, 61/99, 98, 50, 53.6

[56] References Cited

U.S. PATENT DOCUMENTS

| | | | |
|---|---|---|---|
| 2,597,110 | 5/1952 | Lacy | 61/96 |
| 2,637,172 | 5/1953 | Howard | 61/99 |
| 3,178,892 | 4/1965 | Stimson | 61/96 |
| 3,306,052 | 2/1967 | Kawasaki | 61/88 |
| 3,852,969 | 12/1974 | Gibson | 61/96 |

FOREIGN PATENT DOCUMENTS

| | | | |
|---|---|---|---|
| 2,407,655 | 8/1975 | Fed. Rep. of Germany | 61/87 |

*Primary Examiner*—Jacob Shapiro
*Attorney, Agent, or Firm*—Walter Becker

[57] ABSTRACT

An off-shore drilling and production platform with a working deck for location above the water level and with legs for supporting the working deck and for resting on the sea bed. The legs diverge downwardly and have hollow sections while being interconnected at their upper regions only.

41 Claims, 21 Drawing Figures

103
107
113
114
104
110
109
120
105
100
121
99
60
95
96
33
131
132
117
118
90
91
127
129
125
36
41
57
104
105
100
99
95
96
35
44
30
45
40
II
II
41
50
53
43
36
48
56
57
37
45
58
44
47
46
63
65
69
67
70
71
72
82
79
77
80
81
31
87
88

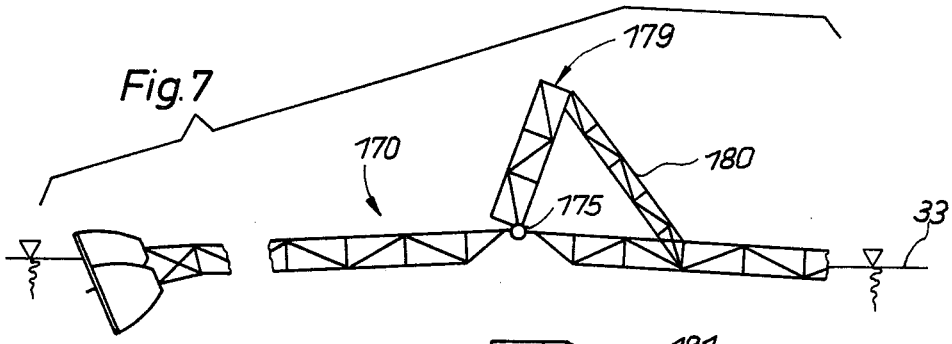
Fig.7
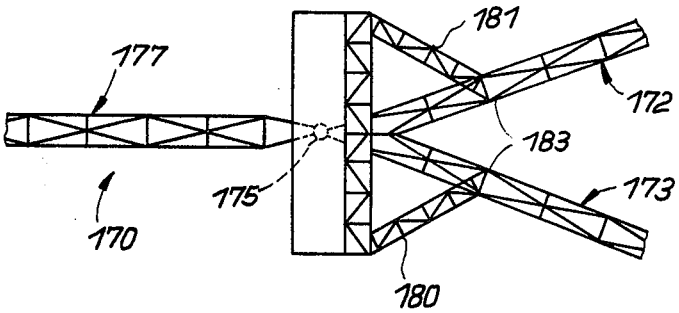
Fig.8
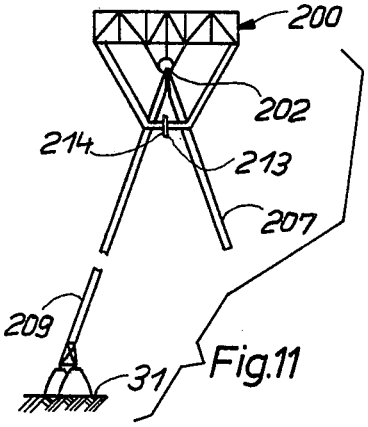
Fig.11
Fig.9
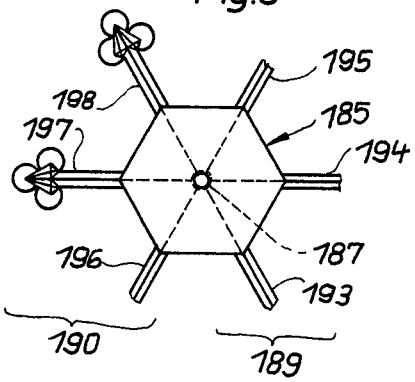
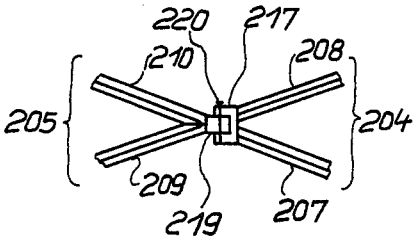
Fig.12
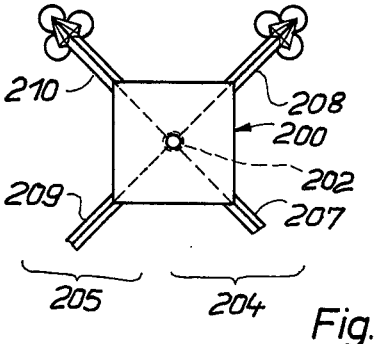
Fig.10

Fig. 20
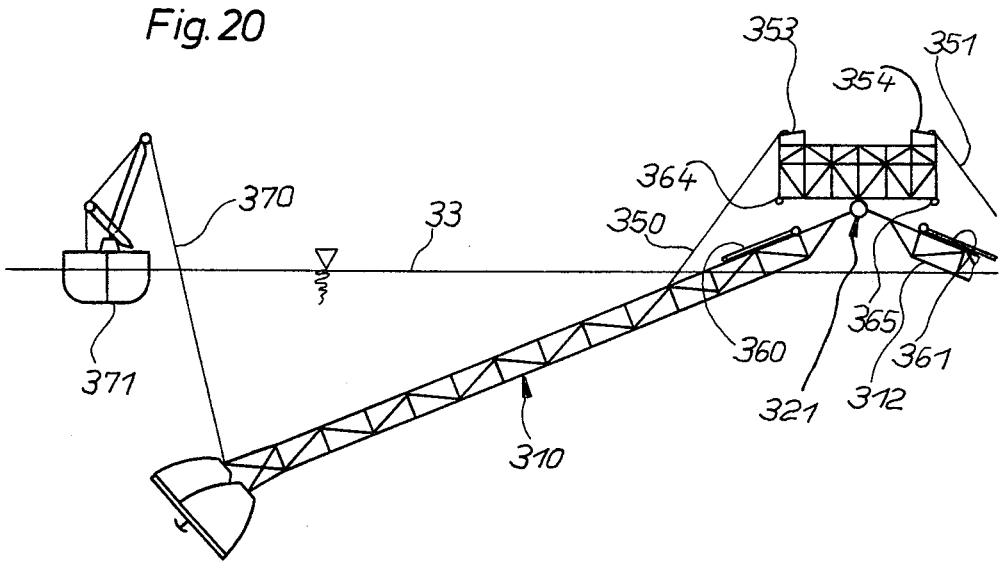
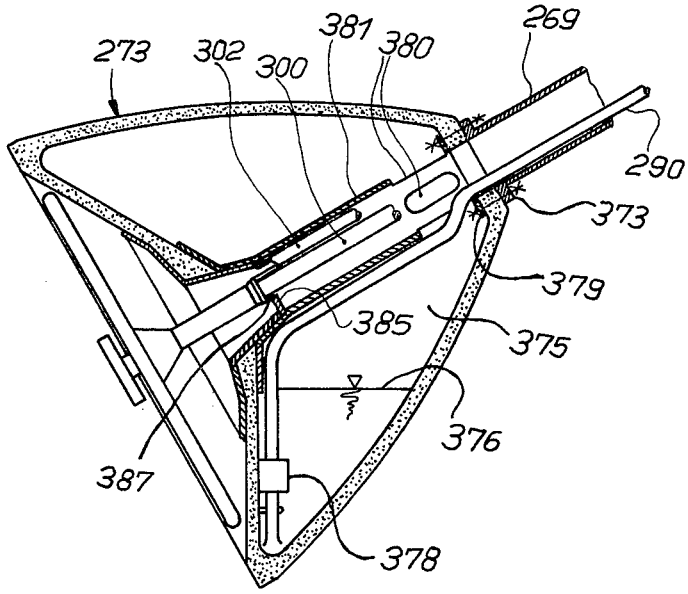
Fig. 21

OFF-SHORE DRILLING AND PRODUCTION PLATFORM AND METHOD OF BUILDING SAME

The invention first of all relates to a fixed drilling and production platform having a working deck above sea level supported on the sea floor by means of legs having hollow sections or spaces and diverging towards the sea floor.

A platform of this type has been disclosed (World Oil, July 1974, Page 89) which has three legs each consisting of a wteel tube of constant diameter. Each leg is pivotally connected at the bottom to a concrete base and at the top to a guide ring. The bottom joints of adjacent legs are interconnected by a tube each. Furthermore, there is a tube leading from the bottom joint of each leg to a central vertical column which extends through the guide ring towards the top and carries a working deck there. The erection of this complicated tubular frame and the working deck is carried out in situ and, consequently, is difficult, time-consuming and affected by the weather. The platform according to the disclosure can be used only down to a limited depth of the sea, e.g. 135 m.

The invention has for its object to simplify the design, transport and erection of a drilling and production platform and to make the platform suitable for use in sea depths hitherto not attainable.

This object is achieved according to the invention in having the legs interconnected only in the region of their upper ends. Preferably, the legs are made of steel. The platform may have three or more legs. The connection of the legs with each other according to the invention eliminates the need to assemble leg elements under difficult conditions below sea level and, in particular, on the sea floor. The legs are instead interconnected near the sea level in an advantageous manner so that what relatively little assembly work is required during the erection of the platform may even be carried out above sea level.

According to one embodiment of the invention, each leg is formed as a three-post space lattice frame with tubular posts. This structure is very stable and offers relatively little resistance to wind and waves. Each post may be formed with an axially continuous hollow space and a gas-tight wall. This enables the individual posts to be flooded or pumped out separately from each other. The hollow space of each post may furthermore be connectible with a pressure gas pipe. This connection is preferably provided above sea level. The pressure gas may be relatively cheap compressed air supplied for safety reasons by a battery of air cylinders and compressors installed on the working deck.

According to another embodiment of the invention, the hollow space of each post communicates with an opening at the bottom end of the post with the hollow space of a spud tank attached to the bottom end of the post joined to said opening. In this fashion, the volume of the hollow space of the spud tanks can be made to assist control in positioning the legs. Moreover, an isolating valve may be installed in each pressure gas pipe to interrupt the supply of pressure gas and a discharge valve for the pressure gas. The latter serves to admit pressure gas to or discharge pressure gas from the aforementioned hollow spaces as desired.

According to a further embodiment of the invention, each post is provided with a pipe for a ballast liquid leading from the top of the post down into the hollow space of its spud tank. This pipe is preferably laid inside the post. Ballast liquid may be sea water. The pipe permits accurate flooding of the hollow spaces in the spud tanks and posts as well as pumping out of these hollow spaces if this is necessary to control the setting up of the platform. Pumping out is simplified if the pipe terminates at least roughly at the lowest point of the hollow space in the spud tank. The pipe may also be connected in this area with a pump for pumping out the ballast liquid from the post and/or the spud tank. Alternatively, pumping out may be effected by increasing the gas pressure in the aforementioned hollow spaces.

According to one embodiment of the invention, the cross sectional area of at least one post in each leg increases towards the top up into the zone of the sea level. The object of this feature is to achieve a stable state during the complete operation of lowering the legs and/or leg groups and during the lowering of the platform onto the sea floor. This increasing cross-sectional area results in a shift of the point of attack of buoancy of that leg towards the top. At least one post of each leg may be shaped as a hollow truncated cone. The posts may also be shaped to taper from their maximum cross-sectional area towards the joint area of the legs in order to produce wave resistance and to facilitate connecting the legs with each other. A particularly advantageous design is obtained if the three posts of each leg are arranged at the corners of an equal-sided triangle. Thus, one post of each leg may face towards the outside from the longitudinal axis of the platform. This will then provide a wide connecting area as is desirable for connecting the legs with each other.

According to a further embodiment of the invention, each leg is provided at its top with part of a joint that cooperates with the other joint members. On the one hand, this affords sufficient freedom of the legs relative to each other during transport from the construction yard to the destination of the platform and, on the other hand, erection of the legs being articulated to each other is greatly facilitated at destination. Especially where floating transport of the platform is envisaged, it is advantageous if the joint is designed as a universal joint according to the invention. This enables the legs to avoid each other without any constraint on their joints if sudden local wind and wave loading arises. As a result, excessive and unsafe stressing of the individual parts of the platform are avoided. This movement of the legs relative to each other may be kept within desired limits by suitable measures, such as control ropes between the individual legs and the pre-assembled working deck. Generally, transport of the platform from the construction yard to destination is by means of a fleet of tugboats that are distributed around the floating platform in a manner that will permit relative movements of the part of the platform to be minimized by local tug pull.

The joint members of the legs may be formed as a spherical socket on each engaging mating balls provided on the working deck. The ball sockets are preferably located in the radial direction relative to the ball by some kind of cage which, while permitting the legs to pivot relative to the ball, will prevent them from moving away radially from the ball in an uncontrolled manner.

According to one embodiment of the invention, the joint parts of at least two legs are solidly integrated to form a joint member with which the joint parts of the other leg or legs are jointed by means of a pin. This results in a more stable floating configuration. The solidly interconnected legs include between themselves the angle of the final standing configuration at destination. Where more than three legs are provided, the legs may be divided into two groups whose joint parts are each solidly connected to form a joint member, the two joint members being jointed to each other by means of a pin. This type of solid joint interconnecting the legs before sea transport is completely safe because bending stresses in the legs due to wind and wave action would be absorbed due to the high inherent flexibility of the legs. If necessary, transport guards that are stiff in bending may be applied between adjacent legs and removed before erecting the platform at its destination.

According to one embodiment of the invention, an intermediate member is jointed by means of a pin to the joint member and via an auxiliary pin to the remaining joint parts or the remaining joint member, whereby the longitudinal axes of the pins are spaced apart and turned relative to each other through 90°. This constitutes a simple universal joint that can be made very stable and robust. Because of the relatively small spacing of the pins, there is no possibility of unsafe stresses of the bearing parts arising.

According to a further embodiment of the invention a bearing body supporting the working deck is pivotably mounted on said pin. This feature provides the possibility of mounting an extensively equipped and complete working deck before sea transport of the rig is undertaken and to prevent it in a suitable manner from pivoting unintentionally relative to the legs during the sea transport. The working deck is then preferably maintained horizontal at all times. This embodiment will be of great importance when the supply of bigger deck modules by ship is made impossible by the inclemencies of the weather. In contrast to this, the working deck which is extensively assembled and floated together with the legs to the site need only be completed by parts or assemblies that can be flown in by helicopter. A platform of this type can therefore be erected and made operational in a rough sea.

The joint parts and/or joint members may be welded to each other to increase the stability of the platform erected on site.

According to one embodiment of the invention, each leg is formed with at least one erection face below and at a distance from the joint which face is connected with a corresponding erection face of at least one other leg. These erection faces are preferably arranged at such a high level that they can be connected with each other above the surface of the sea before the actual lowering of the legs down onto the sea bed.

According to another embodiment of the invention, two inner posts of each leg terminate at the level of the erection faces and the other post is continued as an extension towards the top to support the associated joint part at its free end. In this fashion, it is possible to realize also relatively acute angles between the legs of the erected platform while an adequate strength of the interconnection of the legs is maintained. With a view to increasing the strength, each extension may be braced by means of lattice bars between its end points and the two inner posts of its leg. Particularly favourable loading conditions are obtained for the complete structure, if the neutral axes of the legs intersect at a point near the point of attack of the maximum resulting horizontal force due to wind and wave loading of the platform.

According to an embodiment of the invention, a guide column extending upwards is attached to one of the joint parts or one of the joint members, which guide column permits a guided axial relative displacement between the guide column and the working deck, there being a bracing jointed with its one end to one of the legs and with its other end to the outside of the working deck. The guide column is capable of being arrested at desired axial positions relative to the working deck. Favourable static conditions are obtained, if the bracings are jointed to the legs at least substantially in the plane of the erection faces. Alternatively, the bracings may be jointed to the underside of the working deck with intermediate supports extending from a region between the joint axes of each bracing and a central area of the underside of the working deck. This arrangement provides a very stiff space lattice truss between the legs and the working deck. In addition, the joints of the bracings may be welded to make them stiff. A particularly favourable supporting arrangement is by bracings in the form of plane trusses.

According to another embodiment of the invention, a central column extending upwards is attached to one of the joint parts of the legs or to one of the joint members with deck segments associated with one leg or a group of legs being hinged to the central column and bracing being joined at one end to one of the legs or group or legs and at the other end of the free end of the associated deck segment. The deck segments are formed and arranged so that when the legs are in their final standing position, they will be in a horizontal plane and supplemented by further deck sections to form a continuous working deck area. Intermediate supports may extend from an area between the joint axes of each bracing to a central area of the deck or to the central column if a high stiffness of the substructure of the deck is desired.

According to one embodiment of the invention, an erection column extending downwards is provided on one joint part of a leg or on one joint member which erection column is formed with erection faces to be connected with corresponding erection faces of the legs. This arrangement results in a very stiff interconnection of the legs and positive location of the joint part or joint member supporting the erection column. The bracing may be jointed at least substantially in the plane of the erection faces on the legs. Again, the joints of the bracing may be welded to make them stiff and each bracing may be formed as a plane lattice truss. As mentioned earlier, the interstices of the working area between the deck segments may be closed by filling segments. Furthermore, a crane may be arranged on top of the central column to enable the working deck to be completed and fitted out in a very straightforward manner.

According to another embodiment of the invention, the deck or part of the deck is solidly connected to the joint member of a leg group and supported by bracing on the associated leg group. After lowering the legs onto the sea bed, the deck or part of the deck will assume a horizontal position. If only part of the deck is so connected, this may be completed and fitted out after the lowering of the legs onto the sea floor.

According to another embodiment of the invention, a linkage which is axially movable and a pipe for bulk material are taken through and sealed against the wall of the spud tank to reach into the sea water. An opening may be provided in the wall of the spud tank to connect the post and an opposite opening to the sea water with both openings being connected by a tubular member inside the spud tank accommodating the linkage and the pipe for the bulk material, said tubular member having sealed in it a bulkhead with penetrations for the linkage and the pipe. The tubular member may have penetrations near its post-end end permitting the introduction of, for instance, ballast liquid and ballast bulk material into the spud tank.

A method for erecting a platform having one or several of the aforementioned features is characterized by the following steps:

(a) The legs and/or leg groups are launched separately and connected in a manner that the joint is formed so that they remain movable relative to each other at least in the vertical plane, (b) the unit so formed is towed to the intended site of the platform, (c) the legs and/or groups are turned down by controlled flooding of the hollow spaces in the posts and spud tanks through the pipes for the ballast liquid while the gas pressure in these hollow spaces is increased simultaneously until their erection faces contact their mating faces, (d) the erection faces are solidly connected with their mating faces, (e) the hollow spaces in the legs and/or leg groups are flooded under control until the spud tanks have descended to a predetermined distance from the sea bed prior to making the foundations and (f) the foundations are prepared.

The legs and leg groups may be assembled in a dockyard and brought into the necessary floating position for the step (a) by means of, say, lighters. The step (a) may be effected in coastal, and therefore relatively smooth, waters. Step (b) provides for an extensively prefabricated unit to be towed to the site so that time-consuming and frequently difficult, if impossible, assembly work is eliminated. The righting of the platform is effected simply by turning down the leg and/or leg groups from the transport floating position according to step (c) until the erection position is reached where the only operation is to secure the erection faces according to step (d) which is preferably done above the surface of the sea. If desired, it is possible at this stage also to stiffen the joints, e.g. by welding. As soon as these operations to establish the final standing configuration have been completed, the steps (e) and (f) follow. The complete turning down and lowering of the platform takes place in a stable floating and/or submersed position and, consequently, with the necessary degree of safety.

According to an embodiment of the invention, the following step is provided between the steps (a) and (b):

(a1) Ballast liquid is introduced through the pipe of at least one post of each leg into the associated spud tank until the legs have assumed a transport floating position. As a result of the controlled flooding of the spud tanks in this step (a1), it is possible to incline the legs slightly to horizontal, e.g. until the two bottom spud tanks of each leg are fully submerged and, thereby, are protected from the direct effects of wave action.

Very sensitive and accurate control of the turning down of the legs and the lowering of the platform onto the sea bed is obtained by the spud tanks and the posts being flooded or pumped out under control action individually or in groups independent of other spud tanks and posts or post groups.

According to one embodiment of the invention, the following step is provided between the steps (a) and (b) or (a) and (a1):

(a2) The working deck is slid onto the guide column and the bracing is joined to the deck and the legs and/or leg groups. These operations are carried out preferably substantially or completely above the surface of the sea.

According to another embodiment of the invention, the following step is provided between the steps (a) and (b) or (a) and (a1):

(a3) The working deck segments are jointed to the central column and the bracing to the legs and/or leg groups. After making the foundations of the platform, additional deck sections can be added to form the continuous working deck.

According to an embodiment of the invention, the following step is provided between the steps (a) and (b) or (a) and (a1):

(a4) The deck or part of the deck is solidly connected with the joint member of a leg group and supported with bracing on the associated leg group.

According to another embodiment of the invention, step (a) also includes assembling the bearing unit with the working deck and, subsequently, locating the deck relative to one leg or a leg group by means of braces for the subsequent steps up to step (c). Thus, the deck is secured in a form-locking manner during the sea transport.

According to another embodiment of the invention, step (a) includes assembly of the bearing unit with the working deck and, subsequently, locating the deck relative to one leg or a leg group by means of braces for the subsequent steps up to step (f) with a further step being added:

(g) The braces are detached and the deck is brought into its horizontal final position and secured in this position. As a result, the deck remains secured in a form-locking manner during the complete sea transport and setting up of the platform on the sea bed.

For the purpose of towing in step (b) it is advantageous to connect adjacent legs of a leg group with each other by fitting one or several stiff struts to the legs at a distance from the joint. These braces will be removed and recovered at the site before turning down the legs.

According to another embodiment of the invention, one or several legs and/or leg groups are connected for the purpose of towing in step (b) by guy ropes to the outer edge of the deck attached at a distance from the joint. Such guy ropes enable undesirably great turning motions of the legs relative to each other to be prevented. This aim can also be achieved if, according to a feature of the invention, the course of each leg during towing in step (b) is corrected by means of a rocket motor fitted in the lower end region of the leg. The rocket motor may be of the solid-fuel type.

According to another embodiment of the invention, at least one rope leading to a winch which is permanently installed on the outside of the deck is applied to each leg and leg group at a distance from the joint for the steps (c) and (d) or for step (g) until the deck has been secured in its horizontal final position relative to the legs.

These winches maintain the deck in a horizontal position during the turning down of the legs and setting down of the platform onto the sea floor.

According to an embodiment of the invention, a rope of a crane vessel is applied to the lower end of each leg for the steps (c) to (e). This arrangement serves as a further safeguard to enhance the safety during turning down of the legs and setting down the platform onto the sea bed.

According to another embodiment of the invention, ballast liquid is expelled from the spud tanks and/or the posts by increasing the gas pressure in the system. This expelling of the liquid can be an advantage in maintaining a desired working speed during turning down of the legs and setting down the platform on the sea floor. Utilizing the gas pressure will eliminate the need for using liquid pumps.

A number of embodiments are illustrated in the drawings in which.

Figure 13:
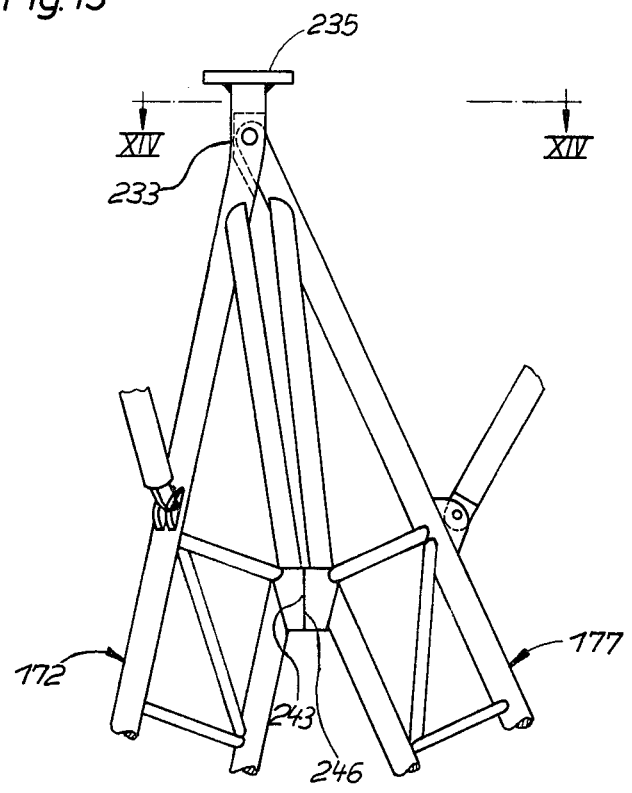
Figure 14:
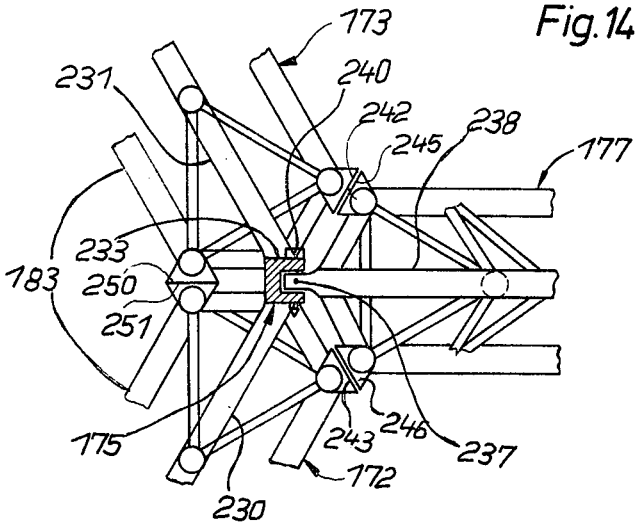

FIG. 7 is a partial side view of another alternative of the platform with a modified top configuration in the floating position, FIG. 8 is a plan view of part of the platform shown in FIG. 7, FIG. 9 is a schematic plan view of a platform with six legs, FIG. 10 is a schematic plan view of a platform with four legs, FIG. 11 is a side view of the platform shown in FIG. 10, FIG. 12 is the joint of the platform shown in FIG. 10, FIG. 13 is a partial side view of a modified connection area of legs, FIG. 14 is a sectional view along the line XIV—XIV in FIG. 13.

Figure 15:
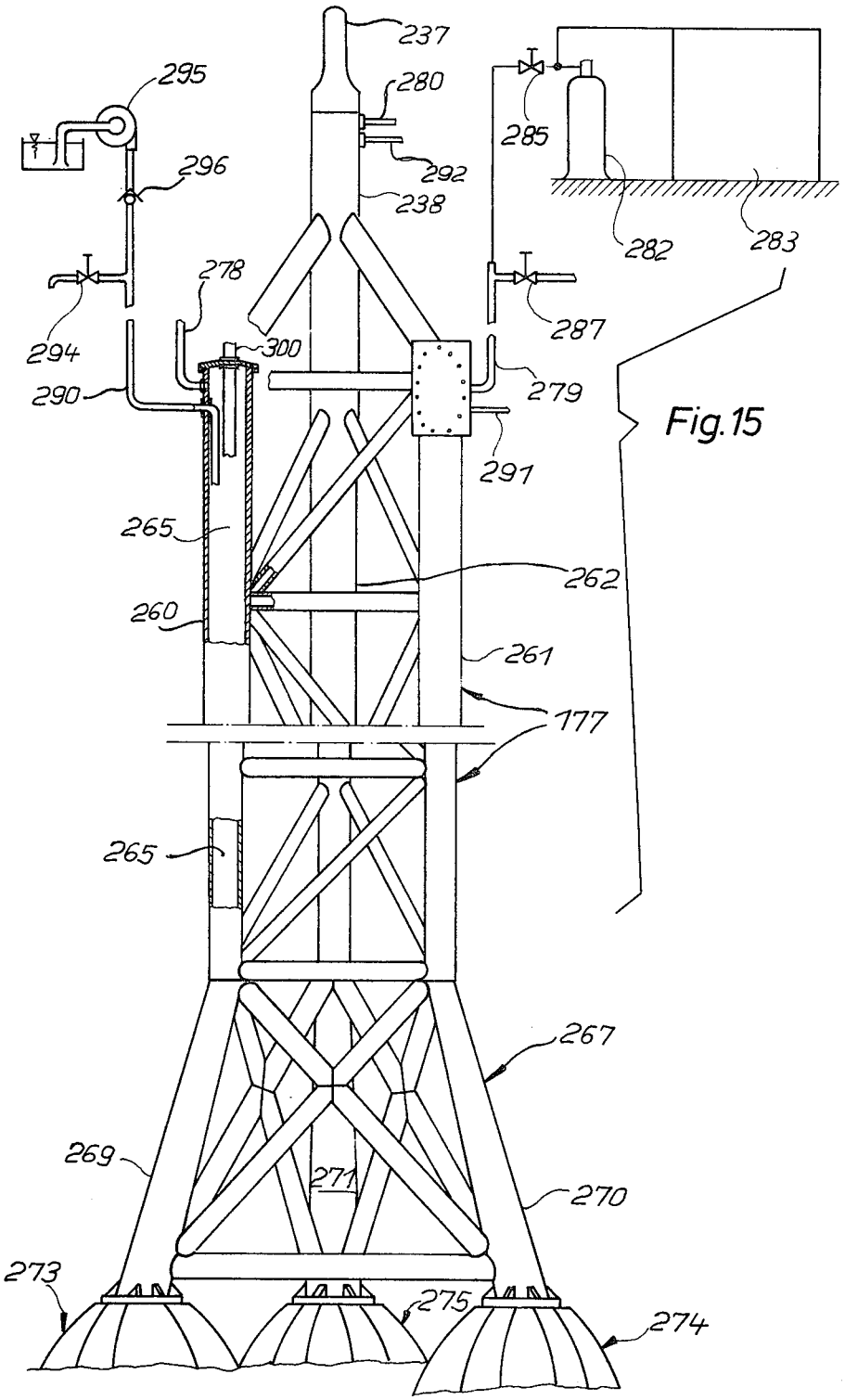
Figure 16:
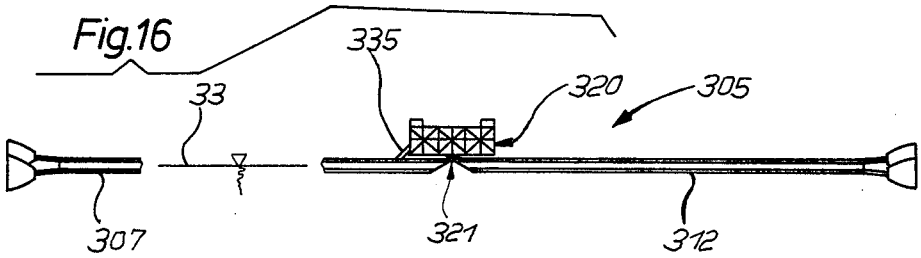
Figure 18:
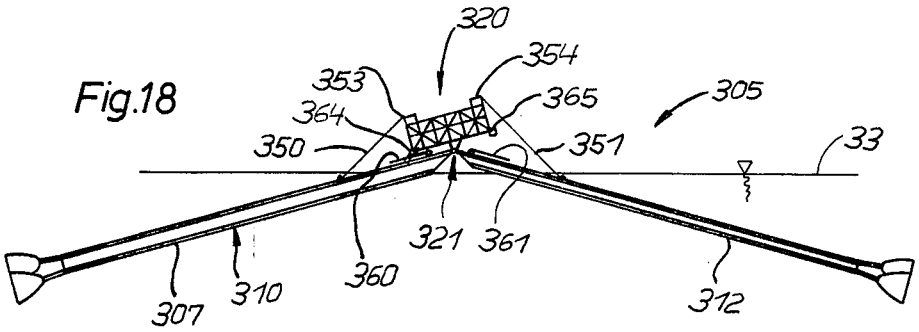
Figure 17:
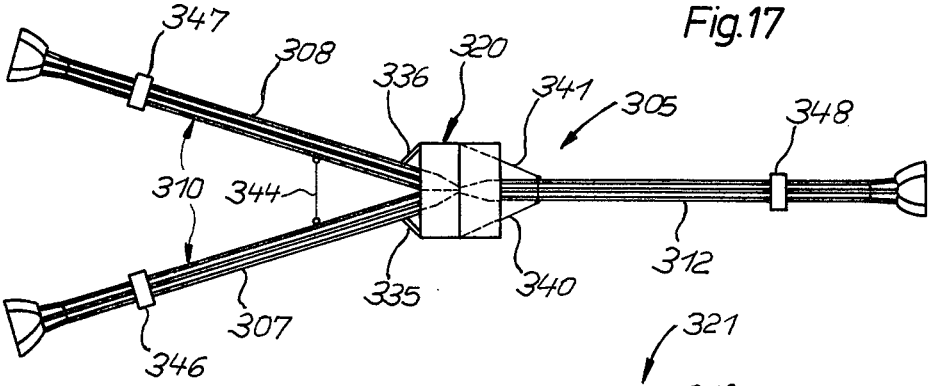
Figure 19:
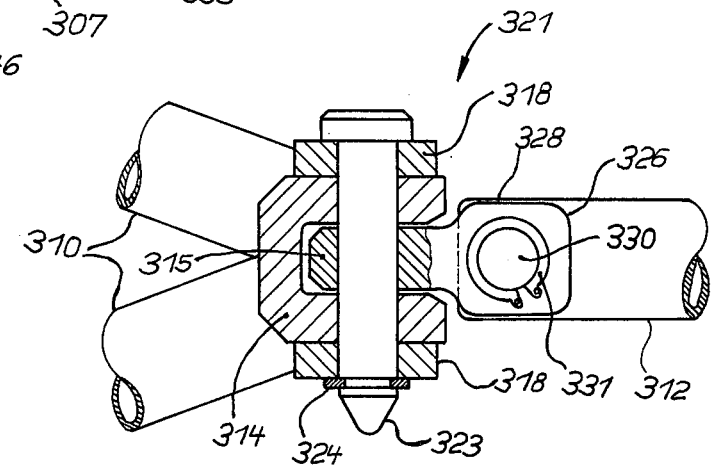

FIG. 15 ia a side view of a leg, partly sectioned, with equipment added,

FIG. 16 is a side view of a platform with an alternative joint arrangement of the deck in the floating position, FIG. 17 is the plan view of the platform shown in FIG. 16, FIG. 18 is the platform shown in FIGS. 16 and 17 during turning down of the legs, FIG. 19 is a partially sectioned view of a universal joint for the legs, FIG. 20 is a side view corresponding to FIG. 18 with an additional crane vessel, and FIG. 21 is a schematic sectional view of a spud tank.

Figures 1, 2, 3:
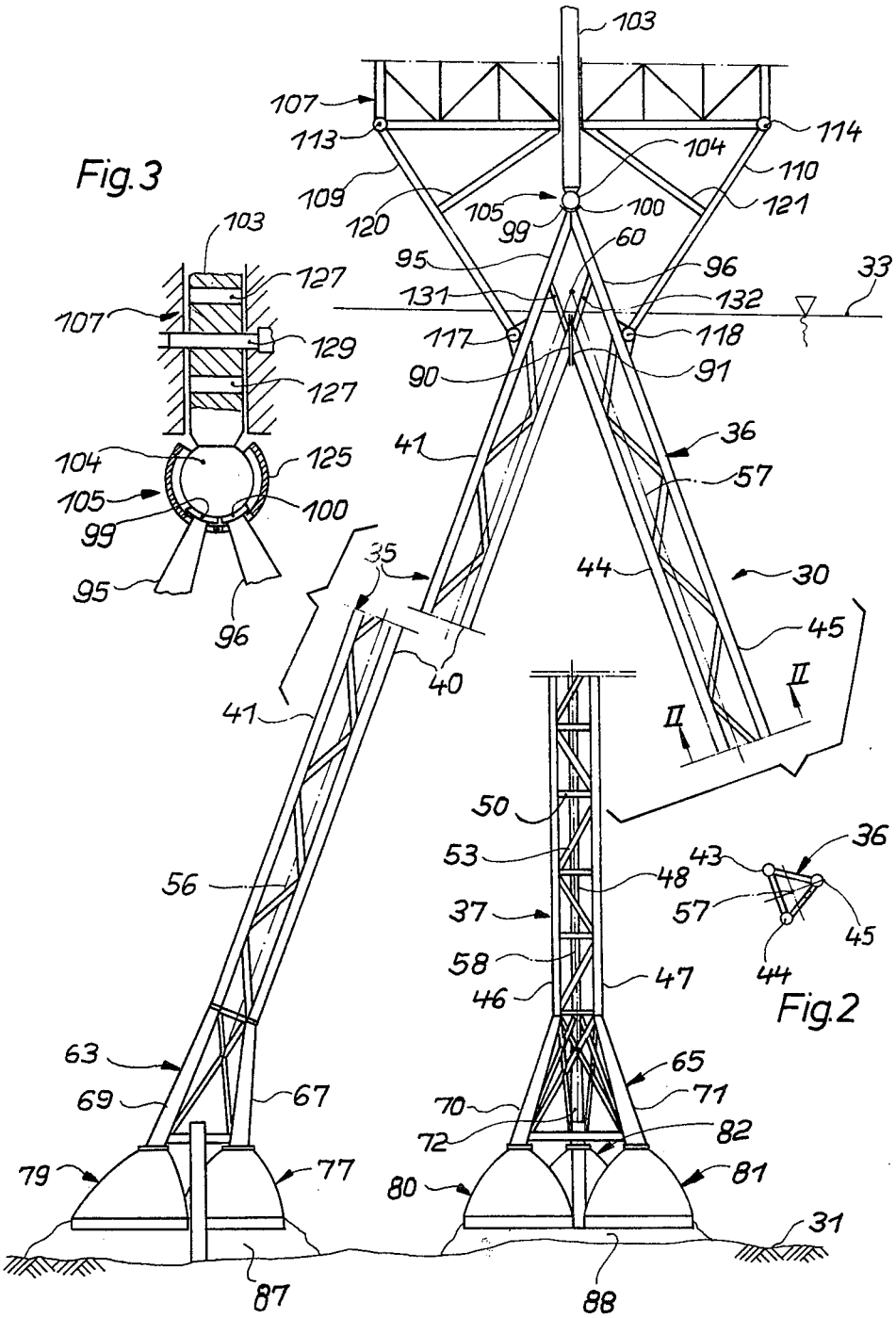
FIG. 1 is a schematic part side view of a platform with three legs that are independent of each other.
FIG. 2 is a section through a leg along the line II—II in FIG. 1.
FIG. 3 is an enlarged detail from FIG. 1.

In FIG. 1, a drilling and production platform 30 stands on the sea bed 31 with the top part of the platform 30 extending above the surface of the sea 33. The platform 30 has three legs 35, 36 and 37 arranged to diverge towards sea bed 31 and interconnected only in a region near the surface of the sea 33.

According to FIG. 2, each leg is formed with tubular posts 40, 41; 43, 44, 45; 46, 47, 48 arranged at the corners of an equilateral triangle with the posts being interconnected by horizontal members, e.g. 50 and diagonal members (e.g. 53), to form a space framework.

The neutral axes 56, 57 and 58 of the legs 35, 36, 37 intersect at a point 60 near the point of application of the resulting horizontal force due to wind and wave loading of the platform 30, i.e. a short distance above the surface of the sea 33. Attached to the lower end of each leg 35, 36, 37 is a transition structure, e.g. 63 and 65. Each transition structure again is formed as a space framework, having three posts 67, 69; 70, 71, 72 at its corners whose hollow spaces which are not shown communicate with the hollow spaces in the posts 40 to 45 of the legs. The posts 67 to 72 of the transition structures 63 and 65 each have a spud tank 77, 79; 80, 81, 82 attached to their bottom end and the hollow space in each spud tank communicates with the hollow space of the associated post. These spud tanks rest on a ballast bed 87 and 88 so that the platform 30 is firmly supported on the sea bed.

the two inner posts 40; 44; 46, 47 of each leg are provided with mating erection faces, e.g. 90 and 91 at their upper ends which may be firmly secured to each other by, for instance, bolts. The outer post 41; 45; 48 of each leg is formed with an extension e.g. 95; 96 reaching beyond the erection faces 90; 91. Each extension 95; 96 is fitted at its upper end with a spherical bearing 99; 100 in which is supported a ball 104 of a universal joint 105 with the ball 104 being attached to a guide column 103.

A working deck 107 is supported on the guide column 103 so as to be slideable in an axial direction. Bracings, e.g. 109; 110 are attached by means of joints 113; 114 to the outside of the deck 107 and at their other ends by joints 117; 118 to the legs 35; 36 at the level of the erection faces 90; 91. Intermediate supports 120; 121 extend from a region between the joint axes of each bracing 109; 110 to the central area of the underside of the deck 107 to complete the substructure of the deck.

Referring to FIG. 3, the spherical bearings 99; 100 are surrounded by a cage 125 which permits only a slight radial movement of the spherical bearings 99; 100 relative to the ball 104. The guide column 103 is provided with a number of holes 127 above each other in which a pin 129 can be inserted which with its outer ends engages the deck 107. In this manner, the guide column 103 can be secured at alternative axial positions relative to the deck 107.

Figure 4:
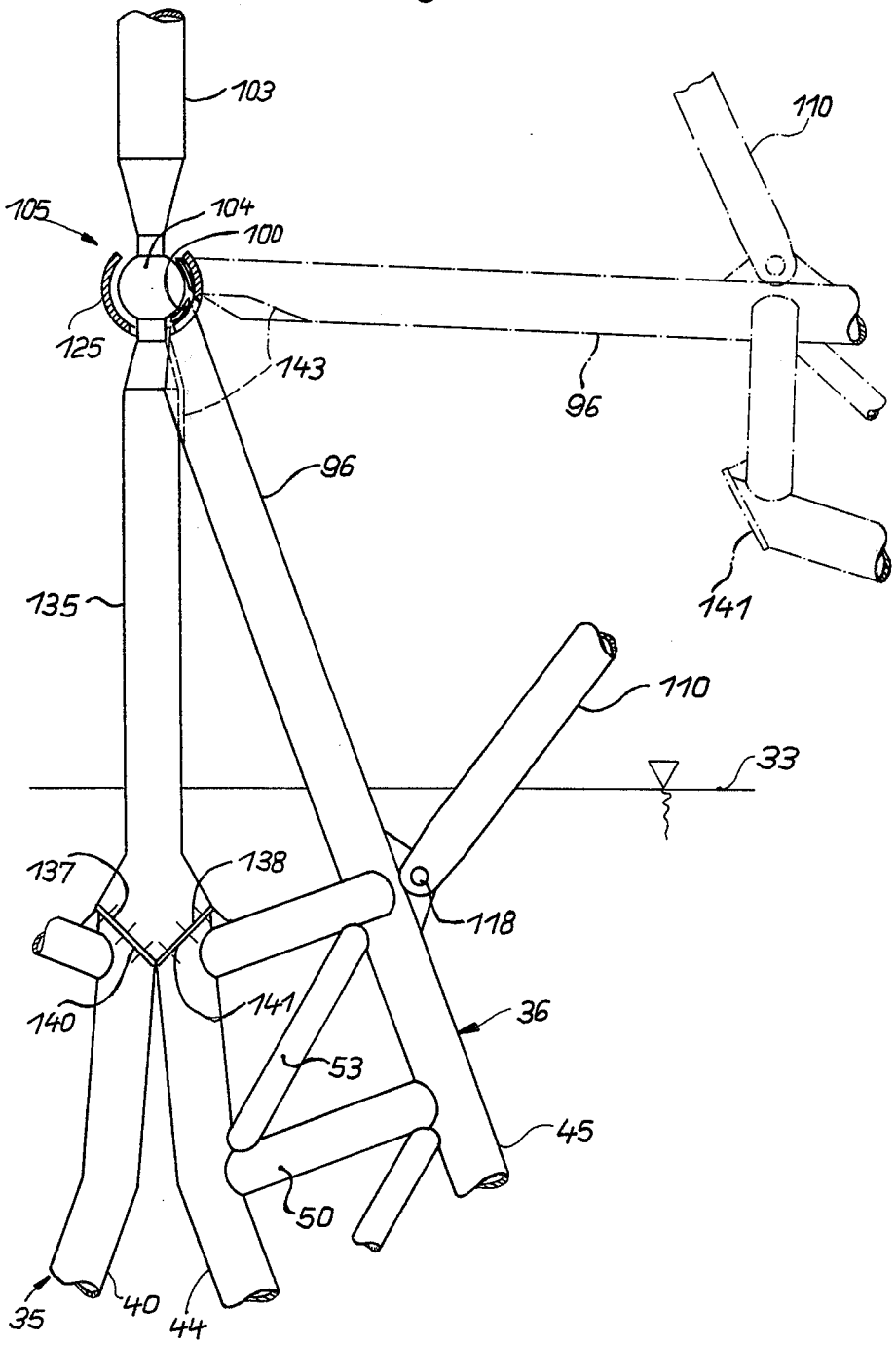
FIG. 4 is an alternative connection of legs to that shown in FIG. 1.

Each extension 95; 96 is braced between its ends against the two inner posts, e.g. 40; 44 of its leg 35; 36 by means of lattice members 131; 132. Such lattice members are not absolutely required if, according to FIG. 4 an erection column 135 is attached to the bottom of the ball 104 of the universal joint 105 which column 135 is formed with erection faces, e.g. 137; 138 at its bottom which are connected with mating erection faces 140; 141 of the inner post 40; 44 of the legs 35; 36. Each extension, e.g. 96 is formed with a guide recess 143 at its inside and top end which, when the legs are turned down from the floating position shown by chain-dotted lines in FIG. 4 into their final position will in cooperation with the erection column 135 align the associated leg 36 to fit the erection faces 138; 141.

With a view to simplifying the description and representation, the same parts have been provided with the same references in the figures of the drawings.

Figure 5:
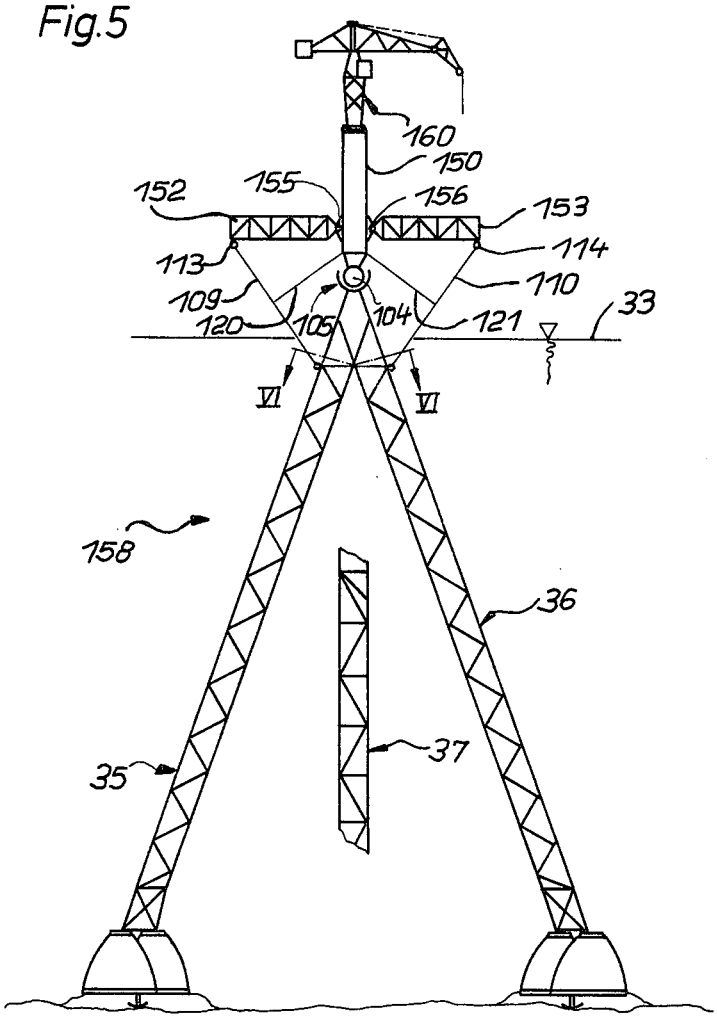
FIG. 5 is a partial side view of a platform with an alternative top configuration.

Referring to FIG. 5, a central column 150 is secured to the ball 104 of the universal joint 105 at the top instead of the guide column 103. The deck segments 152; 153 fitted with joints 113; 114 are jointed at their inner end by means of joints 155; 156 to the central column 150 and, during sea transport of the platform 158, form an acute angle with the central column 150. A crane 160 is mounted on top of the central column 150.

Figure 6:
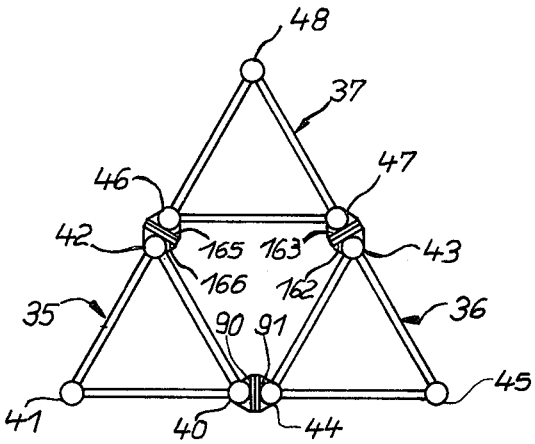
FIG. 6 is a section through the legs along the line VI—VI in FIG. 5.

FIG. 6 clearly shows the cross-sectional layout of the legs 35; 36; 37 consisting of equilateral triangles. Erection faces 162; 163 are provided between the posts 43 and 47 and erection faces 165; 166 are provided between the post 46 and post 42 of leg 35 facing it.

FIG. 7 and 8 illustrate an alternative drilling and production platform 170 in the floating position. The platform 170 is formed with two solidly interconnected legs 172; 173 which are connected at a joint 175 with a third leg 177. Attached to a joint member associated with legs 172, 173 but not illustrated in detail, there is a part 179 of the deck which is supported by braces 180; 181 on the legs 172; 173 forming a leg group 183. Thus, the leg group 183 and the deck part 179 together with the braces 180 and 181 will turn bodily about the universal joint 175 when the platform 170 is erected at the site. The deck part 179 will eventually after completion of the operation of turning down the legs assume a horizontal postion.

FIG. 9 shows a deck 185 which is supported via a joint 187 by two leg groups 189 and 190 which each has three legs 193, 194 and 195 as well as 196, 197 and 198. In a similar manner, a deck 200 is supported in FIG. 10 via a joint 202 by two leg groups 204 and 205 of which each has two legs 207 and 208 as well as 209 and 210. Each of these leg groups 204; 205 is provided with at least one erection face 213; 214 illustrated in FIG. 11 by means of which the leg groups 204; 205 are connected to each other.

FIG. 12 shows that the legs 207 and 208 of the leg group 204 are attached to a fork-shaped joint member 217, whereas the legs 209; 210 of leg group 205 terminate in an eye-shaped joint member 219. The joint members 217 and 219 are hinged to each other by a pin 220.

FIGS. 13 and 14 show the connection area of the leg groups 183 and the leg 177 of the embodiment illustrated by FIGS. 7 and 8 in greater detail. Attached to the top ends of the extensions 230 and 231 of legs 172 and 173 is a fork-shaped joint member 233 which at its top carries a support plate 235 according to FIG. 13 for the deck. The joint member 233 is engaged by an eye-shaped joint part 237 at the upper end of an extension 238 of leg 177. The joint member 233 and joint part 237 are interconnected by a pin 240.

The erection faces 242 and 243 of the leg group 183 are facing the erection faces 245 and 246 of the leg 177. The legs 172 and 173 were solidly connected to the erection faces 250 and 251 at the dockyard.

FIG. 15 shows the leg 177 enlarged and with details. Leg 177 is provided at its three corners with a post 260, 261 and 262 each in the shape of a hollow truncated cone enclosing a continuous hollow space, e.g. 265.

Attached to the bottom end of the leg 177 is a transition structure 267 whose three posts 269, 270 and 271 at the corners each with hollow spaces communicating with the hollow spaces, e.g. 265, of the posts 260, 261 and 262 of the leg 177. The hollow spaces in the posts 269, 270 and 271 each communicate with the hollow space exemplified in FIG. 21 of the spud tanks 273, 274 and 275 attached to the ends of these posts.

Each hollow space, e.g. 265, of leg 177 is joined by a pressure gas pipe 278, 279 and 280. Each pressure gas pipe, e.g. 279, is connected to a pressure gas source 282 and a compressor 283 which are both provided to improve availability. An isolating valve 285 permits the supply of pressure gas to be interrupted, and a discharge valve 287 permits pressure gas to be removed from the hollow spaces in leg 177, the transition structure 267 and the spud tanks 273, 274 and 275.

Furthermore, a pipe 290, 291 and 292 for a ballast liquid is run through each post down to the hollow space of the associated spud tank. An emptying valve 294 is connected to each of these pipes, e.g. 290. Furthermore, each pipe, e.g. 290 incorporates a pump 295 and a non-return valve 296 through which ballast liquid introduced into the system. Each post of leg 177 and, moreover, those of all other legs of the platform are arranged so that pressure gas and/or ballast liquid can be separately admitted or discharged independent of the other posts.

Furthermore, there is a linkage (e.g. 300), extending in each post of leg 177 down into the associated spud tank 273, 274 and 275 as well as a pipe 302 shown in FIG. 21 to handle bulk material required for the making of the foundations and which is not therefore described in detail here.

FIG. 16 to 18 illustrate a drilling and production platform 305 formed with a leg group 310, consisting of two legs 307 and 308, and another leg 312.

The leg group 310 terminates in a fork-shaped joint member 314 shown in FIG. 19 which accommodates the eye of an intermediate member 315. The joint member 314 is clasped on the outside by a fork-shaped bearing body 318 whose connecting base, which in FIG. 19 is above the plane of the drawing, is connected to the deck 320 which can be seen in FIGS. 16 to 18. The parts 314, 315 and 318 of the universal joint 321 are penetrated by a pin 323 which is secured by a retainer 324.

Spaced from the eye of the intermediate member 315, there is a fork (326) of the intermediate member 315 which accommodates an eye-shaped joint part 328 of the leg 312. An auxiliary pin 330, which is secured outside the fork 326 by a retainer 331, enables the leg 312 to turn relative to the fork 326.

In the floating position shown in FIGS. 16 and 17, the deck 320 is located relative to the leg group 310 by braces 335 and 336. Furthermore, there are guy ropes 340 and 341 applied to the outside of the deck 320 on the centre-line of the pin 323 which have their other ends attached to the leg 312. For further stabilization of the floating configuration during sea transport, a strut 344 which is stiff in bending is inserted between the legs 307 and 308. In addition, each leg 307, 308 and 312 is equipped with a rocket motor 346, 347 and 348 which permits thrusts to be applied to the legs in any desired direction.

Before the legs are turned downwards from the floating position illustrated in FIGS. 16 and 17, ropes 315 and 351 are applied to the leg group 310 and the leg 312 which have their other ends each taken to a winch 353 and 354. Then the leg 312 and the leg group 310 are turned down and connected with each other at the erection faces and the platform is set down on the sea bed and the foundations made. After loading the ropes 350 and 351, the braces 335 and 336 are removed so that the deck 320 is maintained in a horizontal position only by the winches 351 and 354. Then the bracings jointed to the leg group 310 and the leg 312, e.g. 360 and 361 are turned up and secured with the associated joints 364 and 365 to the deck 320. After this, the ropes 350 and 351 may be unloaded to be detached from the legs and hauled in.

FIG. 20 is similar to FIG. 18, except that a rope, e.g. 370 of a crane vessel 371 is applied to leg group 310 and another rope is applied in a similar manner not specifically shown, to leg 312. In addition to the control facility afforded by the pressure gas and the ballast liquid in the hollow spaces of the legs, the crane vessels will assist controlled turndown of the legs which can even be stopped at any desired time. The procedure illustrated in FIG. 20 differs from that employed in FIGS. 16 to 18 inasmuch as the ropes 350 and 351 are loaded and the braces 335 and 336 (FIG. 17) are removed before lowering of the leg group 310 and the leg 312 is started.

Referring to FIG. 21, the post 269 is formed at its bottom end with a flange 373 by means of which it is bolted to the spud tank 273. The spud tank 273 is of cup-shape and made of reinforced concrete with a hollow space 375 and contains ballast liquid up to a level 376. The ballast liquid has been introduced through the pipe 290 into the hollow space 375 and can be expelled again by means of a pump 378.

Inside the hollow space 375 and facing the flange 373, there is a flange 379 of a tubular member 381 provided with openings 380 in its upper part. The tubular member 381 is provided with a bulkhead 385 providing a gastight seal at its bottom. The bulkhead 385 is penetrated by a linkage 300 with a sealing gland 387 and also by the pipe 302, the penetrations being sealed gastight. Thus, pressure gas admitted through the post 269 will flow through the openings 380 in the tubular member 381 only into the hollow space 375 of the spud tank 372. Sea water from outside the spud tank 263 is prevented from entering the hollow space 375 and, consequently, the post 269.

It is, of course, to be understood that the present invention is, by no means, limited to the specific showing in the drawings, but also comprises any modifications within the scope of the appended claims.

What I claim is:

1. An off-shore drilling and production platform in combination which includes a working deck for location above the water level of the sea in which the platform is to be installed, legs supporting said deck and diverging from said deck in downward direction for resting on the bed of the sea in which the said platform is to be installed, said legs comprising hollow sections and being interconnected in the region of their upper ends only, each leg being formed as a three-post space framework with tubular posts, each post being formed with an axially continuous hollow space with the wall of the hollow space being gastight, the hollow space of each post is being connectible with a pressure gas pipe, each post having a pipe therewith for a ballast liquid extending from the top of the post down to the hollow space of its spud tank, each leg carrying at its top part of a universal joint which cooperates with the other joint parts, at least one grouping of the joint parts and the joint members being welded together.

2. A platform in combination according to claim 1, in which said legs are interconnected in that region thereof which corresponds to the water level of the sea into which the platform is to be placed.

3. A platform in combination according to claim 1, characterized in that the hollow space of each post communicates with an opening at the bottom end of the post and in that said opening connects with a hollow space of a spud tank attached to the bottom end of the post.

4. A platform in combination according to claim 1, characterized in that each pressure gas pipe incorporates an isolating valve to stop the pressure gas supply and a discharge valve for the pressure gas.

5. A platform in combination according to claim 1, characterized in that each post has allied to it a pipe for a ballast liquid extending from the top of the post down to the hollow space of its spud tank.

6. A platform in combination according to claim 1, characterized in that the pipe terminates at least approximately at the lowest point of the hollow space of the spud tank.

7. A platform in combination according to claim 1, characterized in that the pipe is connected with a pump to remove ballast liquid from the post and/or the spud tank.

8. A platform in combination according to claim 1, characterized in that the cross-sectional area of at least one post of each leg increases towards the top up into the region of the water level.

9. A platform in combination according to claim 8, characterized in that at least one post of each leg is in the shape of a hollow truncated cone.

10. A platform in combination according to claim 8, characterized in that the posts are tapered from their maximum cross-sectional area to the region where the legs are connected.

11. A platform in combination according to claim 10, characterized in that the three posts of each leg are arranged at the corners of an equilateral triangle.

12. A platform in combination according to claim 11, characterized in that one post of each leg faces outwards from the longitudinal axis of the platform.

13. A platform in combination according to claim 5, characterized in that each leg carries at its top part of a joint which cooperates with the other joint parts.

14. A platform in combination according to claim 1, characterized in that the joint is formed as a universal joint.

15. A platform in combination according to claim 6, characterized in that the wall of the spud tank is penetrated by a linkage which is axially slidable and by a pipe for bulk material which are sealed in the wall and extend to the sea water.

16. A platform in combination according to claim 15, characterized in that an opening for connecting the post and an opening at the opposite end for the sea water are provided in the wall of the spud tank, in that the two openings are connected with each other by a tubular member arranged inside the spud tank and accommodating the linkage and the pipe for the bulk material, and in that a bulkhead with openings for the linkage and the pipe is inserted and sealed in the tubular member.

17. A platform in combination according to claim 16, characterized in that the tubular member is formed with openings near its post end.

18. An off-shore drilling and production platform in combination, which includes a working deck for location above the water level of the sea in which the platform is to be installed, legs supporting said deck and diverging from said deck in downward direction for resting on the bed of the sea in which the said platform is to be installed, said legs comprising hollow sections and being interconnected in the region of their upper ends only, each leg being formed as a three-post space framework with tubular posts, each post is being formed with an axially continuous hollow space with the wall of the hollow space being gastight, the hollow space of each post being connectible with a pressure gas pipe, each post having a pipe therewith for a ballast liquid extending from the top of the post down to the hollow space of its spud tank, each leg carrying at its top part of a universal joint which cooperates with the other joint parts, the legs being divided into two groups whose joint parts are each solidly united to form a joint member and that the two joint members are articulately connected with each other by means of a pin.

19. A platform in combination according to claim 18, characterized in that an intermediate member is joined via a pin on the joint and an auxiliary pin to the other joint part or the other joint member and that the longitudinal axes of the pins are spaced and turned 90° against each other.

20. A platform in combination according to claim 19, characterized in that a bearing body supporting the deck is pivotably mounted on the pin.

21. A platform in combination according to claim 18, characterized in that the joint parts of the legs are each formed as a spherical bearing and engage a ball of the joint, said ball being allied to the deck and complementary to the spherical bearings.

22. An off shore drilling and production platform in combination, which includes a working deck for location above the water level of the sea in which the platform is to be installed, legs supporting said deck and diverging from said deck in downward direction for resting on the bed of the sea in which the said platform is to be installed, said legs comprising hollow sections and being interconnected in the region of their upper ends only, each leg being formed as a three-post space framework with tubular posts, each post being formed with an axially continuous hollow space with the wall of the hollow space being gastight, the hollow space of each post is being connectible with a pressure gas pipe, each post having a pipe therewith for a ballast liquid extending from the top of the post down to the hollow space of its spud tank, each leg carrying at its top part of a universal joint which cooperates with the other joint parts, each leg being formed with at least one erection face spaced against the joint, said erection face being connected with a mating erection face of at least one of the other legs.

23. A platform in combination according to claim 22, characterized in that two inner posts of each leg terminate at the level of the erection faces and that the outer post in each case continues towards the top as an extension which carries the associated joint part at its free end.

24. A platform in combination according to claim 23, characterized in that each extension is braced by means of lattice members against the two inner posts of its leg.

25. A platform in combination according to claim 22, characterized in that the neutral axes of the legs intersect at a point near the point of attack of the maximum resulting horizontal force due to wind and wave loading of the platform.

26. An off-shore drilling and production platform in combination, which includes a working deck for location above the water level of the sea in which the platform is to be installed, legs supporting said deck and diverging from said deck in downward direction for resting on the bed of the sea in which the said platform is to be installed, said legs comprising hollow sections and being interconnected in the region of their upper ends only, each leg being formed as a three-post space framework with tubular posts, each post being formed with an axially continuous hollow space with the wall of the hollow space being gastight, the hollow space of each post being connectible with a pressure gas pipe, each post having a pipe therewith for a ballast liquid extending from the top of the post down to the hollow space of its spud tank, each leg carrying at its top part of a universal joint which cooperates with the other joint parts, the joint parts of at least two legs being solidly united into a joint member with which the joint parts are articulately connected by means of a pin, one of the joint parts and one of the joint members having a guide column extending upwards attached to it which permits a guided axial relative displacement between the guide column and the deck and in that one bracing each is jointed with one end to one of the legs and with the other end to the outside of the deck.

27. A platform in combination according to claim 26, characterized in that the guide column is arrestable at desired axial positions relative to the deck.

28. A platform in combination according to claim 26, characterized in that the bracings are jointed to the legs at least approximately in the plane of the erection faces.

29. A platform in combination according to claim 26, characterized in that the bracings are jointed to the underside of the deck and in that intermediate supports extend from a region between the joint axes of each bracing to a central region on the underside of the deck.

30. A platform in combination according to claim 26, characterized in that the joints of the bracings are welded to make them stiff.

31. A platform in combination according to claim 26, characterized in that each bracing is formed as a plane lattice truss.

32. A platform in combination according to claim 26, characterized in that a central column extending upwards is attached to one of the joint parts of the legs or one of the joint members, in that deck segments each allied to one leg or a leg group are pivotably connected to said central column, and in that a bracing each is jointed with one end to one of the legs or leg groups and with the other end to the free end of the associated deck segment.

33. A platform in combination according to claim 32, characterized in that intermediate supports extend from a region between the joint axes of each bracing to a central region of the deck or to the central column.

34. A platform in combination to claim 32, characterized in that a joint part of a leg or a joint member has an erection column extending downwards connected to it which is formed with erection faces at the bottom which are connected with mating erection faces of the legs.

35. A platform in combination according to claim 32, characterized in that the bracings are jointed to the legs at least approximately in the plane of the erection faces.

36. A platform in combination according to claim 32, characterized in that the joints of the bracings are welded to make them stiff.

37. A platform in combination according to claim 32, characterized in that each bracing is formed as a plane lattice truss.

38. A platform in combination according to claim 34, characterized in that the interstices of the deck between the deck segments are closed up with filling segments.

39. A platform in combination according to claim 34, characterized in that a crane is provided on top of the central column.

40. A platform in combination according to claim 28, characterized in that the deck or part of the deck is solidly connected with the joint member of a leg group and supported by braces on the associated leg group.

41. A platform in combination according to claim 30, characterized in that the joint parts of at least two legs are solidly united into a joint member with which the joint parts of the leg or other legs are articulately connected by means of a pin.

* * * * *

UNITED STATES PATENT AND TRADEMARK OFFICE

CERTIFICATE OF CORRECTION

PATENT NO. : 4,106,302

DATED : August 15, 1978

INVENTOR(S) : Rudolf Vogel

It is certified that error appears in the above—identified patent and that said Letters Patent is hereby corrected as shown below:

On the Title-Abstract Page, please delete the following:

(73) Assignee: Maschinenfabrik Augsburg-Nurnberg Aktiengesellschaft, Nurnberg, Germany Signed and Sealed this

*Seventh* Day of *June 1983*

[SEAL]

*Attest:*

DONALD J. QUIGG

*Attesting Officer*

*Acting Commissioner of Patents and Trademarks*